US006427881B1

(12) United States Patent
Clodfelter et al.

(10) Patent No.: US 6,427,881 B1
(45) Date of Patent: Aug. 6, 2002

(54) EDGE SEAL CLOSURE

(75) Inventors: Christopher B. Clodfelter; Gary V. Montgomery, both of Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/973,526

(22) Filed: Oct. 9, 2001

(51) Int. Cl.[7] ..... B67D 3/00
(52) U.S. Cl. ..... 222/521
(58) Field of Search ..... 222/39, 41, 519, 222/520, 521, 524, 525, 542, 549, 562

(56) References Cited

U.S. PATENT DOCUMENTS

| | | | | |
|---|---|---|---|---|
| 2,998,902 A | | 9/1961 | Thomas et al. | |
| 3,067,916 A | | 12/1962 | Lerner | |
| 3,121,519 A | | 2/1964 | Cherba | |
| 3,261,513 A | | 7/1966 | Moran | |
| 3,317,093 A | | 5/1967 | Moran | |
| 3,713,586 A | | 1/1973 | Webster | |
| 4,295,584 A | | 10/1981 | Borowitz | |
| 4,583,665 A | | 4/1986 | Barriac | |
| 4,651,885 A | | 3/1987 | Gach | |
| 4,747,518 A | * | 5/1988 | Laauwe | 222/521 |
| 4,771,923 A | | 9/1988 | Zinnbauer | |
| 5,110,017 A | | 5/1992 | Braun | |
| 5,111,967 A | | 5/1992 | Schreiber | |
| 5,228,600 A | | 7/1993 | Steijns et al. | |
| 5,284,273 A | | 2/1994 | Schreiber | |
| 5,305,932 A | * | 4/1994 | Iseli | 222/521 |
| 5,456,374 A | | 10/1995 | Beck | |
| 5,579,957 A | | 12/1996 | Gentile et al. | |
| 5,931,357 A | * | 8/1999 | Wass | 222/562 |
| 6,206,230 B1 | | 3/2001 | Wan et al. | |

FOREIGN PATENT DOCUMENTS

| | | |
|---|---|---|
| DE | 3514132 | 9/1985 |
| EP | 0 558 273 A1 | 9/1993 |
| NO | 121313 | 8/1972 |
| WO | WO 96/21601 | 7/1996 |

* cited by examiner

*Primary Examiner*—Philippe Derakshani
*Assistant Examiner*—Thach H Bui
(74) *Attorney, Agent, or Firm*—John F. Salazar; Middleton Reutlinger

(57) ABSTRACT

A twist open/twist close edge seal closure is described wherein the closure has a sealing disc supported on the interior portion thereof which vertically rises and lowers depending on the rotation of the closure. The sealing disc compresses against the top wall of the container to provide an adequate seal thereof and allows dispensing of the container contents around the exterior portion of the sealing disc upward through a dispensing channel and through the dispensing spout of the edge seal closure.

23 Claims, 7 Drawing Sheets

EDGE SEAL CLOSURE

BACKGROUND OF THE INVENTION

1. Technical Field of the Invention

The present invention relates to twist open twist close edge seal closures and in particular to an edge seal closure which is threadably engaged onto a container and which has a sealing disc located thereon for edge sealing of the container rim.

2. Discussion of the Prior Art

Many types of dispensing closures have been developed for release of liquids or like material held within a container, such as a bottle. Typically, these dispensers feature a closure which is permanently affixed to the container neck or which is threadably held thereon. More often, these closures are formed with an aperture such that, when the closure is twisted open, the aperture reveals a pathway through an interior mouth of the container. For release of liquids held within the container, the closure is twisted to the open position and the container is turned in the upside down position to allow liquid to flow through the neck and mouth of the container. However, most prior art twist open, twist close designs often leak into the threaded area of the container neck, which continues to be a problem. Thus, it is desirable to have a twist open and twist close closure which adequately seals or mates against the rim of the container and prevents these known prior art problems.

U.S. Pat. No. 5,111,967 discloses a plastic dispensing closure for a container which has a twist open, twist close design. This design however utilizes a second softer plastic to provide an effective sealing gasket around the upper portion of the closure. The application of this second softer plastic requires a dual or co-injection molding process in order to mold the closure with a hard plastic and then mold the softer plastic forming the seal thereafter. This second molding step is often prohibitively expensive, time consuming and inefficient.

SUMMARY OF THE INVENTION

The present invention is for an improved twist open/twist close one piece dispensing closure for use with a cooperatively structured container neck. The edge seal twist open/twist close closure of the present invention resolves many of the problems of the prior art devices noted above.

A first object of the present invention is to provide an easy to use twist open/twist close edge seal closure which allows fluid contained in the container to exit therefrom upon opening.

An additional object of the present invention is to provide a twist open/twist close edge seal closure which provides a dispensing spout extending outward from the dispensing orifice and which provides an adequate sealing disc for mating against the rim of the container top wall.

An even further object of the present invention is to provide an edge seal closure which adequately seals the neck of the container and prevents leakage of fluid or other materials in the container from dispensing around the threads of the container when the edge seal closure of the present invention is in the open or closed position.

It is an additional object of the present invention to provide a sealing disc on an edge seal twist open/twist close closure wherein the sealing disc provides a flat mating sealing edge which mates against the rim of the container while also providing a curved surface which depends into the interior of the dispensing orifice of the container.

An additional object of the present invention is to provide a twist open/twist close edge seal closure which is rotatably engaged on the threads of the container neck and which has limit stops preventing the edge seal closure from rotating beyond a particular point from the container.

An even further object of the present invention is to provide a twist open/twist close edge seal closure wherein the sealing disc of the closure has ribs and spokes to support the sealing disc and provide adequate compression against the container top wall and rim such that complete sealing is effectuated when the edge seal closure is fully threaded onto the container neck.

The twist open/twist close edge seal closure of the present invention provides for a twist open/twist close edge seal closure which is threadably engaged on the neck of the container, the edge seal closure having an upwardly extending spout and a side wall with a curved dispensing wall therebetween, a plurality of inwardly extending spokes which are supported against the interior side wall by a matching plurality of ribs, the spokes supporting a sealing disc therebelow, the sealing disc designed such that upon threaded application of the twist open/twist close edge seal closure onto a container, the sealing disc compresses against the top surface of the container.

All of the above outlined objectives are to be understood as exemplary only and many other objectives of the invention may be gleaned from the disclosure herein. Therefore no limiting interpretation of the objectives noted are to be understood without further reading of the entire specification, claims and drawings included herewith.

DESCRIPTION OF THE DRAWINGS

A better understanding of the edge seal closure of the present invention may be had by reference to the attached drawings wherein like numerals referred to like elements, and wherein.

DETAILED DESCRIPTION OF THE PREFERRED EMBODIMENT

Figure 1:
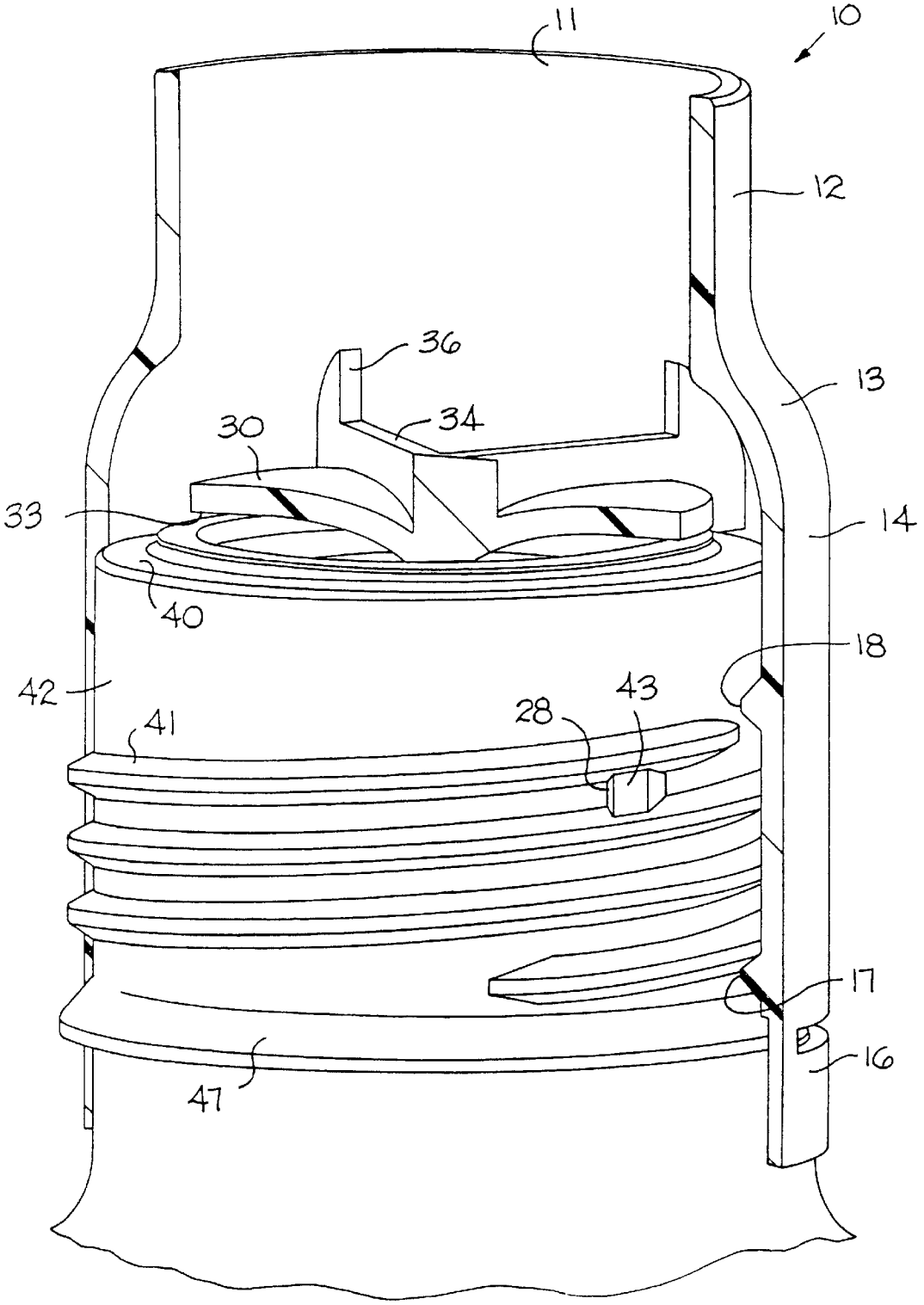
FIG. 1 is a side-sectional view of the edge seal closure of the present invention.

The twist open/twist close edge seal closure 10 of the present invention is depicted in FIG. 1. As seen therein, the edge seal closure 10 is comprised of an upper dispensing spout 12 which has a dispensing aperture 11 located at the upper most portion thereof. Additionally, the edge seal closure 10 has a lower side wall 14 which is below the spout 12 and which has a curved dispensing wall 13 interposed there between. The twist open/twist close edge seal closure 10 of the present invention may also have a tamper indicating band 16 which is frangibly connected to the lower most edge of side wall 14.

The twist open/twist close edge seal closure 10 of the present invention further has a sealing disc 30 on the interior thereof which is provided for mating against the top container wall 40. The sealing disc 30 of the twist open/twist close edge seal closure of the present invention is interposed and held in place interiorly from the outer side wall 14 of the closure and may be placed vertically in the interior portion thereof anywhere between the spout and the lower portion of the side wall inclusive.

As depicted in the present embodiment, the sealing disc 30 is interposed in the interior of the twist open/twist close edge seal closure and is suspended in place by ribs 36 and spokes 34. Ribs 36 are formed interiorly of the closure 10 and adjacent the curved dispensing wall 13 in order to provide adequate support for the sealing disc as the sealing disc 30 will be compressed against the container sealing edge 45. The sealing disc 30, as shown in the present example, is supported by plurality of spokes 34, each of the spokes correspondingly held in place and affixed to the side wall by ribs 36. The plurality of spokes 34 extend inwardly to the center hub 35 which may provide an enlarged support area for disc 30 such that adequate compression against the container top wall 40, and more particularly container sealing edge 45, may occur. Ribs 36 separate the peripheral edge of the sealing disc 30 from the inner surface of side wall 14 to produce a dispensing pathway there between. Thus, the flow dispensing material from the container may be adjusted not only by the vertical disposition of the closure on the container but also by the width of ribs 36.

Figure 2:
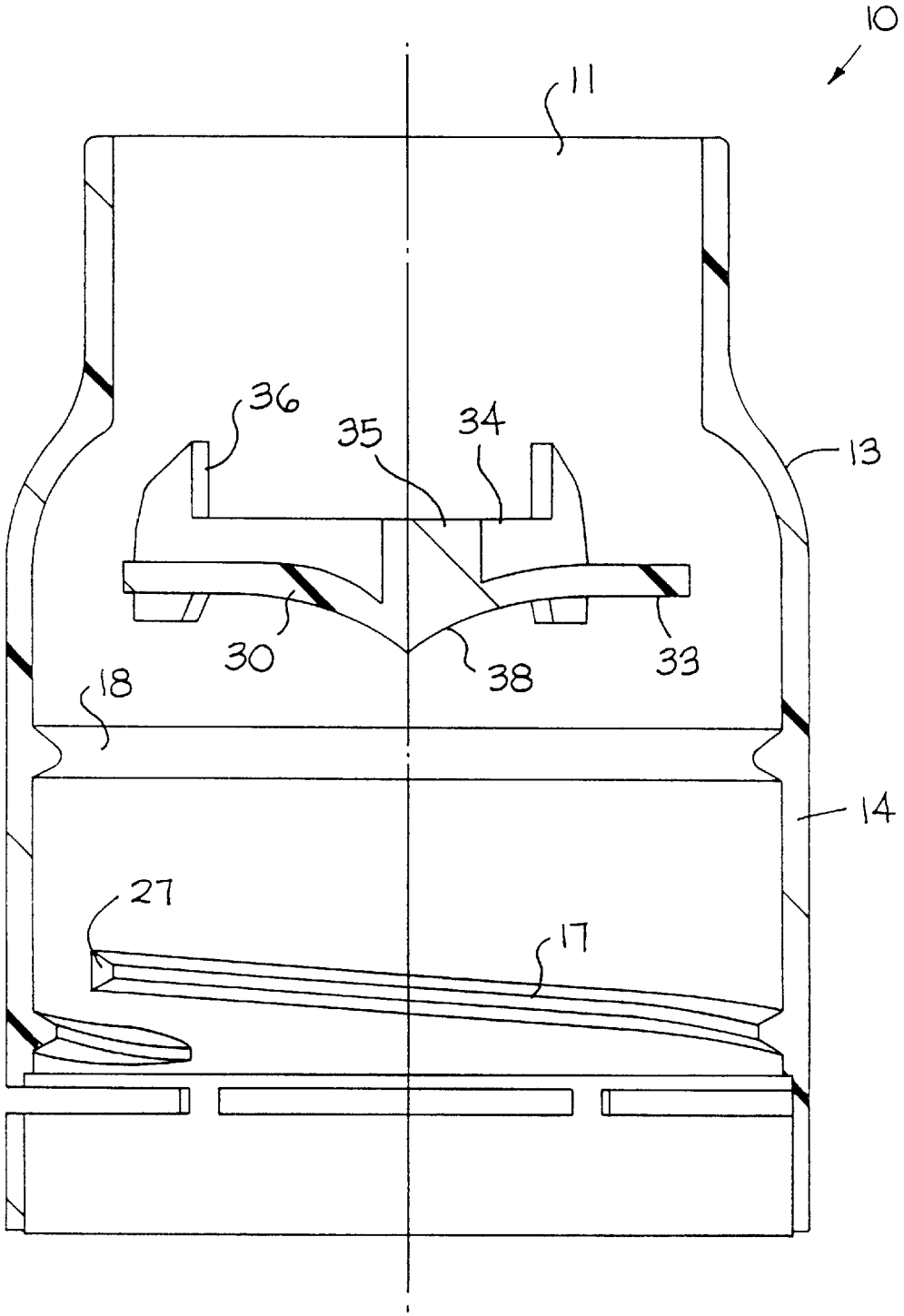
FIG. 2 is a side sectional view of the edge seal closure depicted in FIG. 1.

As depicted in the present embodiment and as is shown in FIG. 2, the sealing disc 30 is annular in order to match the annular container sealing edge 45. However, various embodiments and designs are felt to fall within the teachings and disclosure of the present invention and the teachings herein are not limited to any particular sealing disc or surface.

As shown more clearly in FIG. 2, the sealing disc 30 has a flat sealing edge 33 which is formed on the peripheral portion of the disc 30. Flat sealing edge 33 is provided such that a flat contacting surface is provided for mating against the flat container sealing edge 45 found on the container top wall 40. Adjacent flat surfaces of both the sealing disc 30 and the container sealing edge 45 is used in order that adequate sealing is provided and such that the material contained within the container is not improperly dispensed through dispensing orifice 44. Further, as can be seen from FIG. 2, the sealing disc 30 is comprised of an inner curved surface portion 38 which extends inwardly from the flat sealing edge 33 and which may depend inwardly into the dispensing orifice 44. The design of the curved surface 38 in combination with the flat sealing edge 33, the added support of center hub 35, plurality of spokes 34 and ribs 36 all of which provide adequate support such that increased compression may be brought to bear between the flat sealing edge 33 and the container sealing edge 45.

Figure 1A:
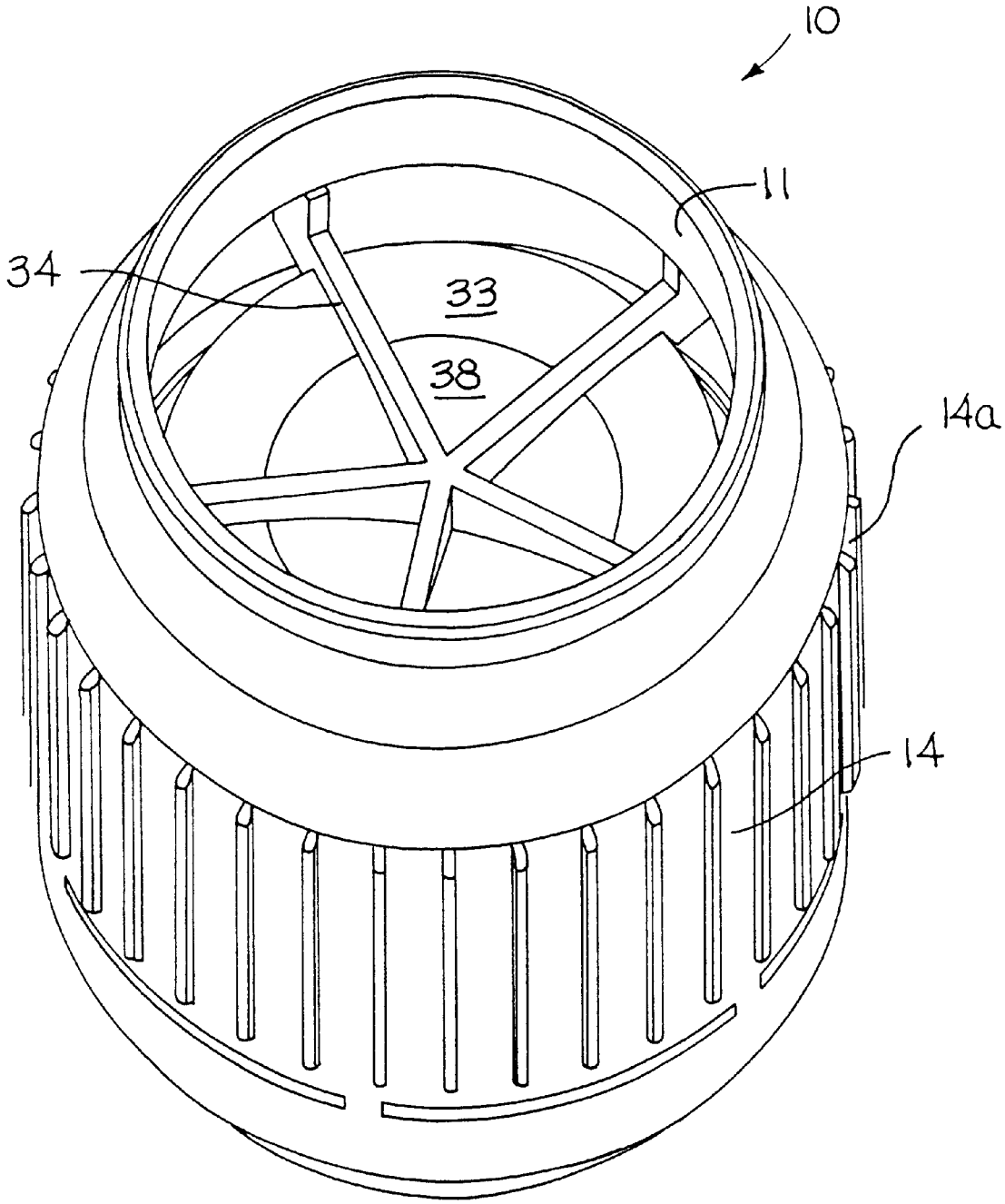
FIG. 1*a* is top perspective view of the twist open/twist close edge seal closure disclosed in FIG. 1.
Figure 3:
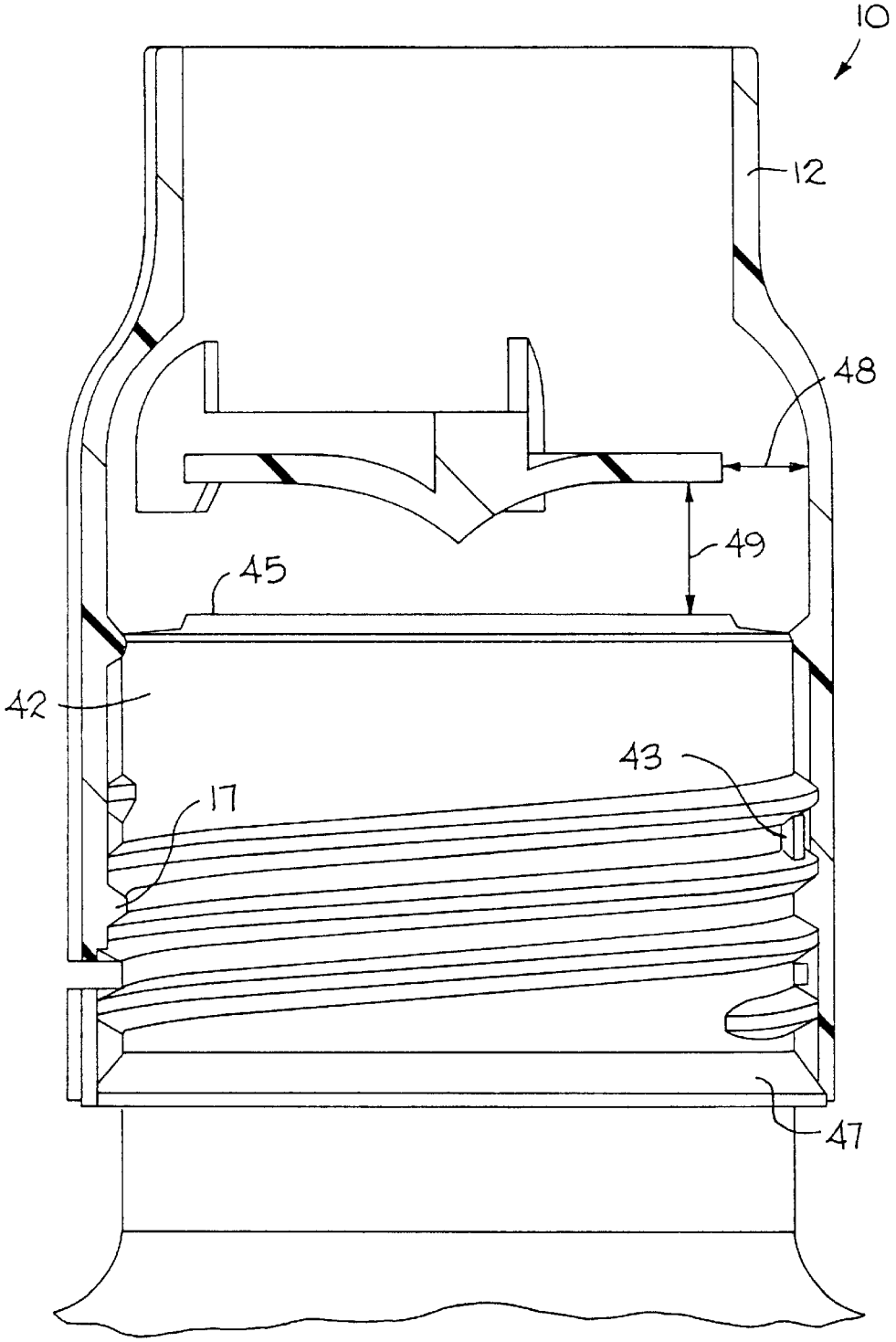
FIG. 3 is a partial side cut away view the edge seal closure and container combination depicted in FIG. 1.

As can be seen from FIGS. 1*a,* 1 and FIG. 3, the twist open/twist close edge seal closure 10 of the present invention is utilized in combination with a container having an upper side wall 44 and at least one thread 41 disposed thereon. As the edge seal closure 10 of the present invention is rotated about the upper side wall 42 and threads 41 of the container, sealing disc 30 moves vertically away from the dispensing orifice 44 of the container such that a dispensing distance 49, as depicted in FIG. 3, is provided for dispensing of material contained within the container. Continued counter-clockwise rotation raises the sealing disc 30, and the entire edge seal closure 10, away from the container neck and container sealing edge 45 and allows material contained therein to be dispensed through the dispensing orifice and upward through release channel 48 between the outer peripheral edge of sealing disc 33 and inner portion of side wall 14.

As can be seen from FIG. 3, the twist open/twist close edge seal closure 10 of the present invention is fully raised such that the material may be dispensed through release channel 48 and through the spout 12 in order to exit the dispensing aperture 11 of the closure 10. The spout 12, provided with the edge seal closure 10 of the present invention, allows for accurate dispensing of the material contents of the container while also preventing the material from leaking back on to the threads of the container. As also noted in FIGS. 1, 2 and 3, there is provided on the interior side wall of the edge seal closure a sealing bead 18 which extends inwardly to contact the upper side wall 42 of the container thereby preventing leakage of the material once dispensed from entering the area between threads 41. The sealing bead 18 may therefore extend inwardly from the side wall 14 of the edge seal closure 10 of the present invention, a sufficient distance such that a compressive seal or contact is made between the sealing bead 18 and the flat upper side wall 42 of the container.

As may also be seen from FIG. 3 and FIG. 1, a stop 43 is provided towards the upper end of threads 41 on the container which will thereby prevent continued counter-clockwise rotation of the edge seal closure 10 of the present invention and to thereby prevent removal of the closure from the container. Thus, as can be clearly seen from FIG. 1, stop 43 is located towards the top end of the thread 41 and may have a flat contacting end 28. As the twist open/twist close edge seal closure 10 of the present invention is rotated in the counter-clockwise direction, thread 17 of the closure, which may have flat thread end 27 depicted in FIG. 2, will eventually contact stop 43 by abutting against flat end 28 and thereby prevent continued counter-clockwise rotation. Such position of the stop 43 may indicate the upper most dispensing distance 49 for vertical travel or disposition of the disc 30 and for the closure 10.

As may be further seen from FIG. 1, a tamper indicating (TI) band may be provided on the lower edge of the side wall 14 which may be frangibly connected to the side wall. Thus, upon initial counter-clockwise rotation of the edge seal closure 10 of the present invention, tamper indicating band 16 may contact tamper indicating bead 47 on the container in interference relationship and, as the side wall 14 rises, TI bead 47 prevents continued movement of TI band 16 thereby causing the TI band 16 to break away from the side wall 14.

As shown in FIG. 1*a,* the twist open/twist close edge seal closure of the present invention may have a plurality of vertical knurls located on the exterior of side wall 14. These plurality of knurls 14*a* may allow easy grasp and turning by the user of the present invention in order to open and close the edge seal closure.

As is also shown in FIG. 1*a,* the sealing disc 30 is supported by the spokes 34 and further has the flat portion 33 and curved surface 38 extending inwardly therefrom. All of these areas provide adequate support and contacting surface for direct sealing of the container sealing edge 45 and closing of the dispensing orifice 44.

The edge seal closure 10 of the present invention may be made of a number of plastics or other material allowing for ease of manufacturing and use. Typical injection molding operations may be utilized to injection mold the closure and various types of plastics are available as long as the peripheral portion 33 of the sealing disc is sufficiently rigid to compressively or tightly seal the container.

Figure 4:
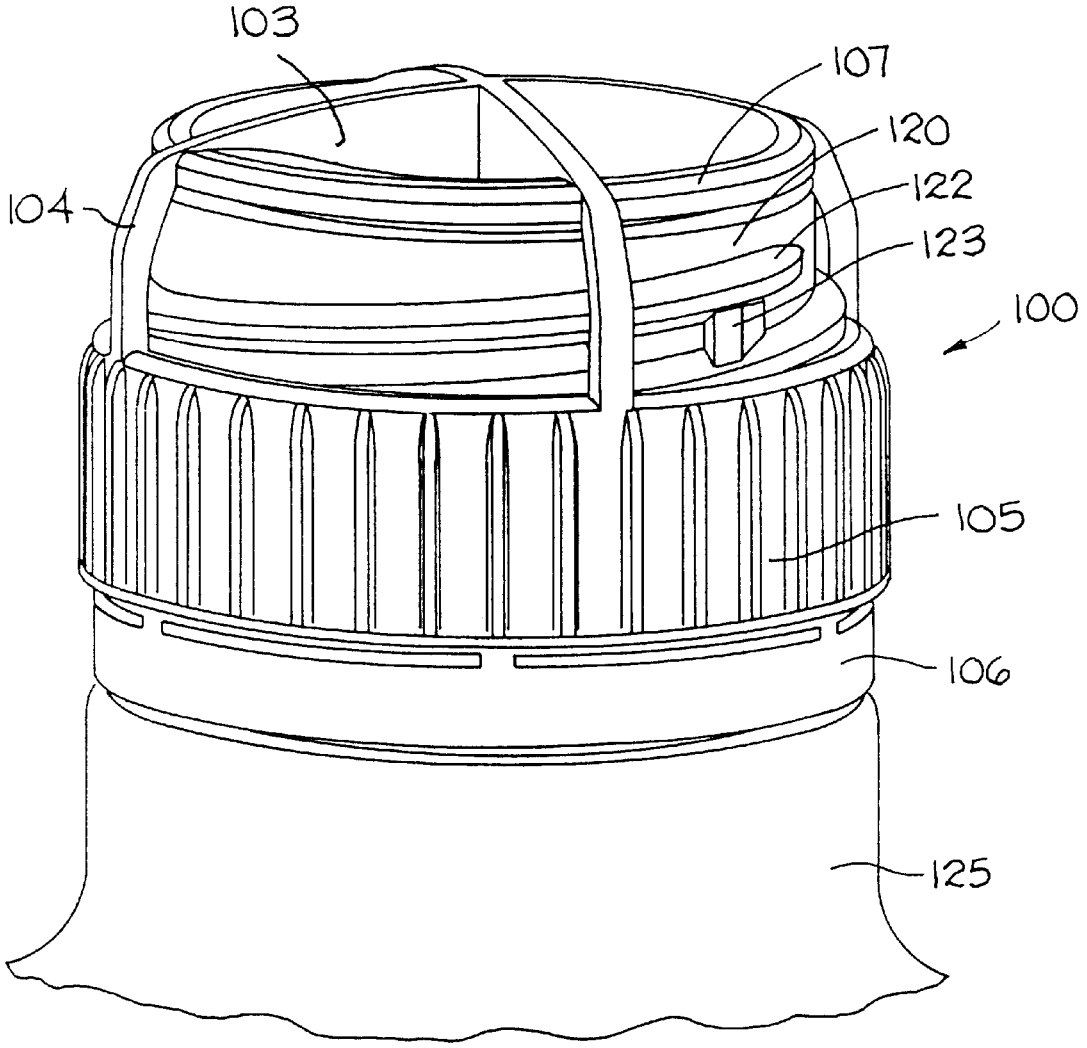
FIG. 4 is a perspective view of an alternative embodiment of the edge seal closure of the present invention.
Figure 5:
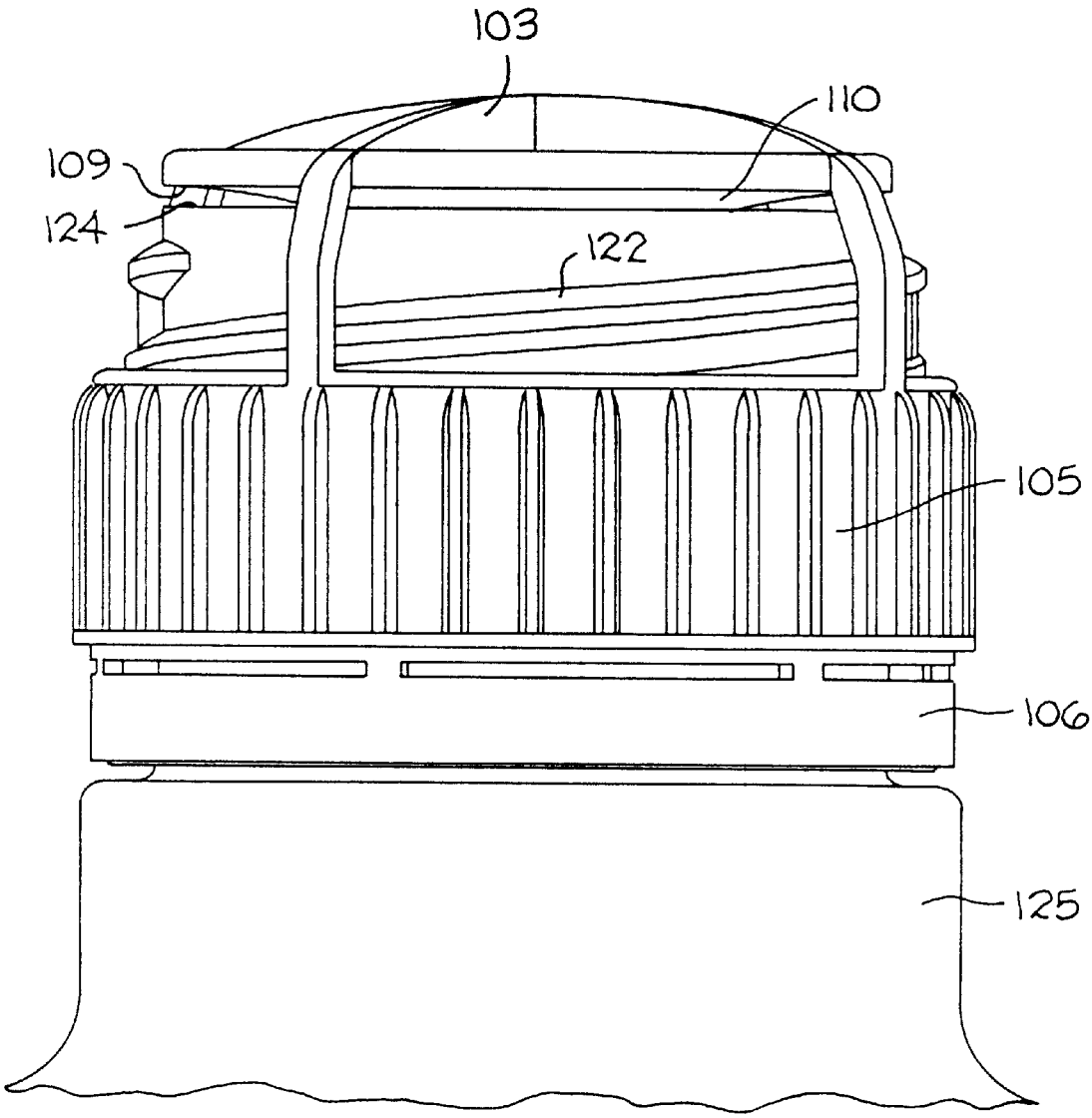
FIG. 5 is a side view of the alternative embodiment depicted in FIG. 4; and, FIG. 6 is a partial side sectional view of the alternative embodiment depicted in FIG. 4.
Figure 6:
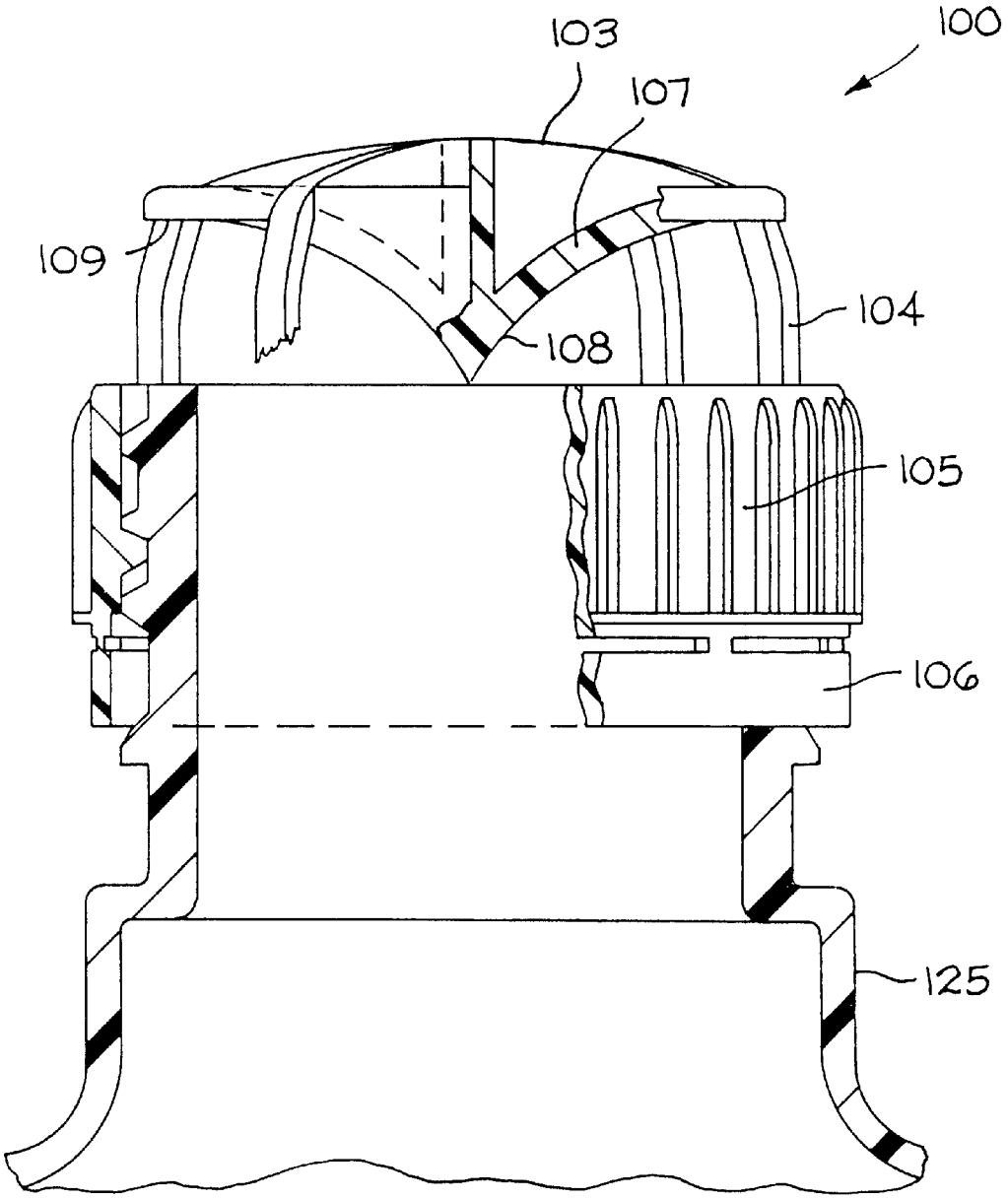

Structures which do not require an upwardly extending spout 12 as disclosed in FIG. 1 may utilize the alternative embodiment of the sealing top 100 depicted in FIG. 4. As shown therein, the collar 105 supports a plurality of upwardly extending spokes 104 which have at their upper most portion inwardly directed supports 103. These supports, as similarly shown in the first embodiment, support along the lower edge thereof the sealing disc 107 which similarly has a flat sealing surface 109 along its outer peripheral edge and an inwardly curved depending sealing portion 108, as is depicted in FIG. 6 and FIG. 5. The flat sealing surface 109 contacts the container rib 124 such that when the collar 105 is rotated in a counter-clockwise direction, the sealing disc 107 separates from the container rim 124 and provides a dispensing channel 110 for release of the container contents. Thread 122 formed on the exterior side wall of the container allows collar 105 to threadably engage the container and vertically rise and lower thereon depending on the rotation imposed on collar 105. The threaded sealing top 100 disclosed in FIGS. 4, 5 and 6 provides an adequate twist open/twist close edge seal closure which does not require an upwardly extending spout but which provides adequate support and compressive seal against the top rim of the container while also providing a visible feedback to the user that the container is adequately closed and sealed. Further, the user may define the proper dispensing channel 110 necessary for dispensing the required amount of material contained within the container.

As is similarly shown in FIG. 1, a stop 123 is placed on container side wall 120 in between threads 122 in order to prevent full removable of the threaded sealing top 100 of this embodiment and thereby limiting the vertical displacement of the sealing disc 107 from the container rim 124. Also, the edge seal closure 100 may further have a tamper indicating band 106 placed thereon such that upon initial rotation of the collar 105 around container neck 125, tamper indicating band 106 separates from the lower most edge of collar 105.

The foregoing detailed description is primarily given for clearness of understanding for the edge seal dispensing closure of the present invention and no unnecessary limitations are to be understood therefrom or from the particular examples, functions and embodiments given herein. Modifications and other variations will become obvious to those skilled in the art upon reading of the disclosure contained herein including the figures and submitted claims without parting from the spirit of the invention of this scope of the appended claims.

We claim:

1. An edge seal closure for a container, comprising:

an edge seal closure having an upper open dispensing aperture and a side wall, said edge seal closure further having a sealing disc disposed within said side wall by a plurality of spokes, said sealing disc separated on a peripheral edge from said side wall;

a container threadably engagable with said edge seal closure and having a side wall and a top wall, said top wall sealingly engageable with said sealing disc of said closure.

2. The edge seal closure of claim 1 wherein said sealing disc has a flat peripheral sealing edge portion engageable with said top wall of said container.

3. The edge seal closure of claim 2 wherein said plurality of spokes extend inwardly to a central hub, said hub extending downward to said sealing disc.

4. The edge seal closure of claim 2 wherein said plurality of spokes are retained against an interior surface of said side wall by a matching plurality of ribs, said ribs separating said flat peripheral sealing edge portion from said interior surface of said side wall forming a release channel therebetween.

5. The edge seal closure of claim 3 wherein said sealing disc further has a downwardly extending curved surface extending inwardly to said hub.

6. The edge seal closure of claim 4 further comprising a thread on an outer surface of said container side wall, said container further having a rotation stop engageable with a distal end of a thread formed on said interior surface of said side wall of said edge closure.

7. The edge seal closure of claim 4 further comprising a spout extending upward from said side wall and forming said dispensing aperture.

8. The edge seal closure of claim 7 wherein said closure further has a curved dispensing wall disposed between said spout and said side wall, said spout having a diameter which is less than the diameter of said side wall.

9. An edge seal closure for a container, comprising:

a vertically disposable threaded closure portion having a side wall, spout and a dispensing wall there between, said threaded closure portion further having a sealing disc disposed centrally therein and separated from said side wall, said sealing disc separated from and retained to an interior surface of said side wall by a plurality of spokes, said interior surface also having at least one thread formed thereon;

a container having a side wall and an open dispensing orifice surrounded by a top wall, said top wall having a sealing edge, said side wall having at least one thread formed thereon;

wherein said sealing disc of said threaded closure portion engages said sealing edge of said top wall of said container when said threaded closure is threaded onto said container.

10. The edge seal closure of claim 9 wherein said plurality of spokes are connected to said interior surface of said side wall by a matching plurality of ribs, said ribs separating said disc from said interior surface of said side wall and forming a dispensing channel therebetween.

11. The edge seal closure of claim 9 wherein said sealing disc has a flat peripheral edge portion and a curved interior portion, said flat peripheral edge portion sealingly engageable with said sealing edge of said top wall of said container.

12. The edge seal closure of claim 11 wherein said sealing edge of said top wall of said container is a flat container sealing edge interior from said top wall of said container.

13. The edge seal closure of claim 11 wherein said closure is threadably engaged to said container and is vertically disposable thereon through said threadable engagement.

14. The edge seal closure of claim 13 wherein said spout has a first diameter and said side wall has a second diameter, said second diameter greater than said first diameter.

15. An edge sealing closure, comprising:

an annular side wall, a plurality of inwardly directed radial spokes formed in the interior of said side wall, a sealing disc supported by said plurality of spokes, at least one thread formed on said interior of said side wall, said sealing disc having a peripheral edge, said peripheral edge separated from said interior of said side wall.

16. The edge sealing closure of claim 15 further comprising a plurality of ribs along said interior side wall connecting said side wall to said spoke, said plurality of ribs providing said separation of said peripheral edge of said sealing disc from said interior side wall.

17. The edge sealing closure of claim 16 further comprising an upwardly extending spout and a curved dispensing wall, said curved dispensing wall disposed between said annular side wall and said spout.

18. The edge sealing closure of claim 17 wherein said spout has a diameter which is less than the diameter of said annular side wall.

19. The edge sealing closure of claim 15 wherein said plurality of radial spokes extend upwardly from a top edge of said side wall.

20. The edge sealing closure of claim 19 wherein said peripheral edge of said sealing disc is vertically separated from said top edge of said side wall.

21. The edge sealing closure of claim 20 wherein said sealing disc has a flat peripheral edge and a depending downwardly extending curved sealing portion, said sealing portion extending interiorly of said side wall.

22. An edge sealing closure, comprising:

an annular side wall, a plurality of inwardly directed radial spokes formed in the interior of said side wall, a sealing disc supported by said plurality of spokes, at least one thread formed on said interior of said side wall, said sealing disc having a peripheral edge, said peripheral edge separated from said interior of said side wall, a plurality of ribs along said interior side wall connecting said side wall to said spoke, said plurality of ribs providing said separation of said peripheral edge of said sealing disc from said interior side wall, an upwardly extending spout and a dispensing wall, said dispensing wall disposed between said annular side wall and said spout.

23. An edge sealing closure, comprising:

an annular side wall, a plurality of inwardly directed radial spokes formed in the interior of said side wall, a sealing disc supported by said plurality of spokes, at least one thread formed on said interior of said side wall, said sealing disc having a peripheral edge, said peripheral edge separated from said interior of said side wall, said plurality of radial spokes extend upwardly from a top edge of said side wall, said peripheral edge of said sealing disc being vertically separated from said top edge of said side wall, said sealing disc having a flat peripheral edge and a depending curved sealing portion, said sealing portion extending interiorly of said side wall.

* * * * *